US007707937B2

(12) United States Patent
Fork et al.

(10) Patent No.: US 7,707,937 B2
(45) Date of Patent: May 4, 2010

(54) DIGITAL IMPRESSION PRINTING SYSTEM

(75) Inventors: David K. Fork, Los Altos, CA (US); Jurgen H. Daniel, San Francisco, CA (US); Dirk De Bruyker, Palo Alto, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 1042 days.

(21) Appl. No.: 11/300,793

(22) Filed: Dec. 15, 2005

(65) Prior Publication Data

US 2007/0139477 A1 Jun. 21, 2007

(51) Int. Cl.
*B41N 1/00* (2006.01)
*B41N 6/00* (2006.01)
*B41C 1/00* (2006.01)

(52) U.S. Cl. ..... 101/395; 101/401.1; 428/908

(58) Field of Classification Search ..... 101/153, 101/170, 368, 395, 401–401.1, 489; 428/72, 428/178, 908
See application file for complete search history.

(56) References Cited

U.S. PATENT DOCUMENTS 6,234,079 B1 5/2001 Chertkow
6,428,146 B1 8/2002 Sharma et al.
6,435,840 B1 8/2002 Sharma et al.
7,121,209 B2 * 10/2006 Vaidyanathan et al. ..... 101/489
7,134,749 B2 * 11/2006 Ben-Zur et al. ..... 347/101
2003/0156178 A1 8/2003 Lehmann

FOREIGN PATENT DOCUMENTS

DE 19746174 C1 7/1999
WO WO02/051639 A 7/2002

OTHER PUBLICATIONS

EP Search Report, Appl. No. EP06126144, Dated Mar. 23, 2007, The Hague, Examiner Martins Lopes.
"Mechatronic system of dielectric elastomer actuators addressed by thin film photoconductors on plastic", Stephanie P. Lacour et al., Sensors and Actuators A111 (2004) 288-292.
"High performance conducting polymer actuators utilising a tubular geometry and helical wire interconnects", Jie Ding et al., Synthetic Metals 138 (2003) 391-398.

* cited by examiner

*Primary Examiner*—Judy Nguyen
*Assistant Examiner*—Marissa L Ferguson-Samreth
(74) *Attorney, Agent, or Firm*—Fay Sharpe LLP

(57) ABSTRACT

A print structure includes a pattern layer that selectively actuates one or more of a plurality of actuators to selectively form one or more wells in a print surface to create a defined pattern on the print surface. A material is applied to the one or more wells and subsequently transferred to another surface in order to transfer the pattern.

6 Claims, 3 Drawing Sheets

DIGITAL IMPRESSION PRINTING SYSTEM

BACKGROUND

The following relates to printing systems and methods. It finds particular application to structures that improve print quality. More particularly, it is directed toward structures that use viscous materials for variable data printing. However, other printing techniques are also contemplated.

Offset printing is a printing technique in which an inked image is transferred (or offset) to a rubber blanket and then to a printing surface. When used in combination with a lithographic process based on the repulsion of oil and water, the offset technique typically employs a flat (planographic) image carrier on which the image to be printed obtains ink from ink rollers, while the non-printing areas attract a film of water, keeping the nonprinting areas ink-free. In other instances, the ink can be applied with a blade or squeegee, as is practiced in the gravure printing process. The ink used for offset printing typically is a highly viscous tar-like material with excellent opacity and little tendency to wick or bleed into the fibers of the paper. The resulting image typically is associated with relatively high image quality (including a sharper and cleaner image than letterpress because the rubber blanket conforms to the texture of the printing surface) and can be formed on various printing substrates (e.g., paper, wood, cloth, metal, leather, rough paper, etc.). However, offset printers generally are inflexible in that every page typically requires a new master.

Variable data printing is a form of on-demand printing in which elements such as text, graphics and images may be changed from one printed piece to the next without stopping or slowing down the press. Thus, variable data printing enables the mass-customization of documents. For example, a set of personalized letters can be printed with a different name and address on each letter, as opposed to merely printing the same letter a plurality of times. This technique is an outgrowth of digital printing, which harnesses computer databases and digital presses to create full color documents. However, the image quality of conventional variable data printing typically is inferior to that of offset printing. This is due at least in part to the differences in the ink used. Because offset printing ink is highly viscous, it typically cannot be ejected from ink jet printers or the like.

Thus, there is an unresolved need for systems and methods that facilitate producing higher quality images with variable data printing.

BRIEF DESCRIPTION

In one aspect, a print structure is illustrated. The print structure includes a pattern layer that selectively actuates one or more of a plurality of actuators to selectively form one or more wells in a print surface to create a defined pattern on the print surface. A material is applied to the one or more wells and subsequently transferred to another surface in order to transfer the pattern.

DETAILED DESCRIPTION

Figure 1:
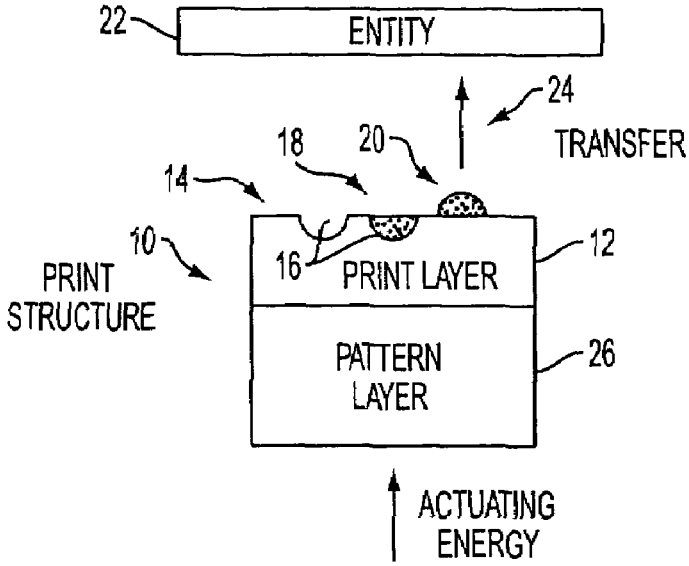
FIG. 1 illustrates an exemplary print structure for printing materials.

With reference to FIG. 1, a print structure 10 for printing various materials such as relatively viscous materials is illustrated. The print structure 10 includes a print layer 12 with a print surface 14 for transferring a material. One or more portions of the print layer 12 can be selectively deformed in order to create one or more wells 16 within the print surface 14. The one or more wells 16 pattern a structure (e.g., an image) on the print surface 14 and are subsequently filled with the material as illustrated at 18. Subsequently, the deformations can be released, which transfers the material within the wells 16 from the wells 16 to the print surface 14 as illustrated at 20. The material can then be transferred from the print surface 14 to another entity 22 as illustrated at 24.

A pattern layer 26 of the print structure 10 resides proximate to the print layer 12. The pattern layer 26 facilitates forming the pattern on the surface 14 of the print layer 12 by selectively forming the wells 16 within the print layer 12. In one instance, the pattern layer 26 includes a semiconductor (not shown) that behaves as an insulator unless exposed to energy with predefined characteristics (e.g., energy, wavelength, periodicity, phase, amplitude, etc.). Portions of the semiconductor exposed to such energy are activated and facilitate forming the wells 16 in adjacent portions of the print layer 12.

In one instance, the pattern layer 26 can include a photoconductor (not shown) that is excited by light. In this instance, optical addressing is used to form the wells on the surface 14 of the print layer 12. For example, upon receiving suitable light the pattern layer 26 can electrostatically form the pattern against the print layer 12. In this instance, an electric field causes one or more portions of the print layer 12 to deform, thus creating the one or more of the wells 16 within the surface 14. The material can then be applied to the surface 14 to fill the wells 16. Upon removing the light source the photoconductor returns to its insulating state. The electrostatic charge is retained and the deformation is maintained. The depressions may then be selectively filled by a viscous ink, for example, with a doctor blade process. The electrostatic charge can be released with a blanket light exposure of the photoconductor, whereupon the wells 16 collapse, which pushes the material to the surface 14. The material is subsequently transferred from the print surface 14 to the entity 22, which re-produces the pattern formed within the surface 14 on the entity 22.

The print structure 10 enables variable data printing using viscous inks, which, relative to comparably lower viscosity inks (e.g., those used in ejection printing), run (or bleed) less into a print substrate such as paper. Since viscous inks typically dry in relatively less time than lower viscosity inks and provide highly saturated colors (by virtue of their higher pigment content), the print structure 10 can be used to increase printing speed and/or print highly saturated colors. It is to be appreciated that the print structure 10 can be used for printing highly viscous inks, lower viscous inks, pastes containing metals, semiconductors, ceramics, etc., as well as other materials on various surface such as paper, ceramic, plastic, velum, etc.

Figure 2:
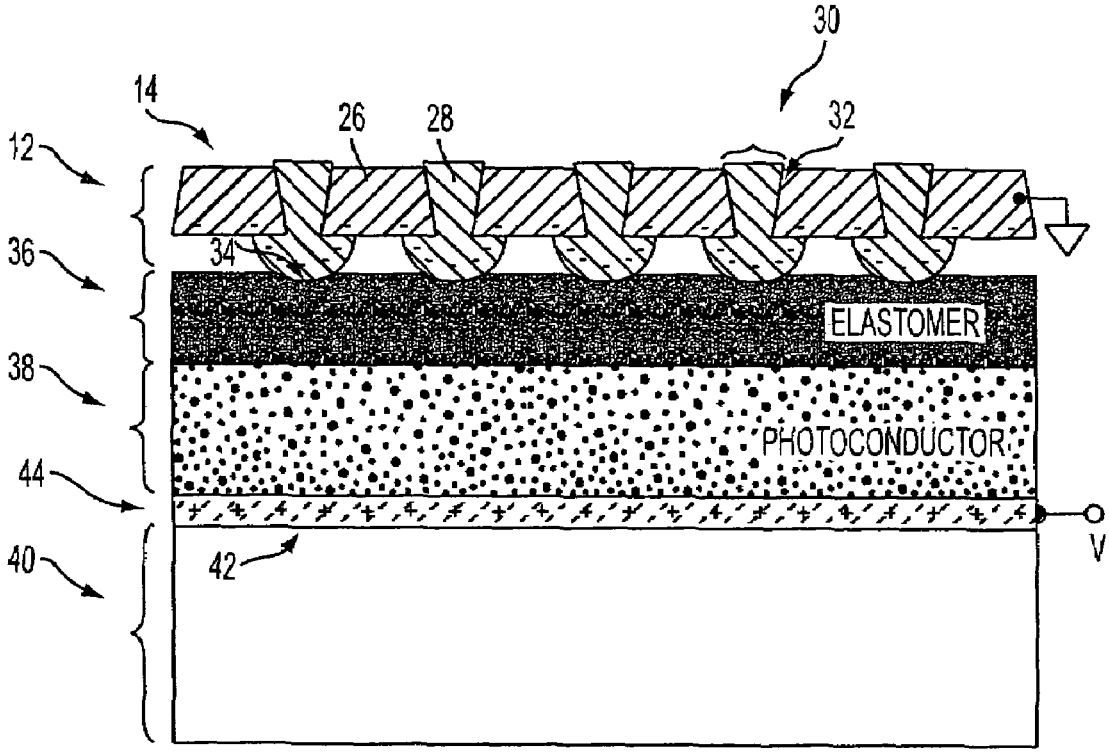
FIG. 2 illustrates a cross section of the exemplary printing structure.

FIG. 2 illustrates a cross section of one configuration of the print structure 10. The print structure 10 includes the layer 12 with the surface 14 that selectively holds and transfers materials such as viscous inks. The layer 12 includes a sheet 26 with one or more pistons 28 (e.g., or similar actuators) residing within one or more apertures 30 of the sheet 26. In one instance, the sheet 26 is a thin foil and the pistons 28 are an array of co-fabricated micro-machined pistons 16. As depicted, the pistons 28 can have tapered walls that pass through tapered walls of the apertures 30. Such tapering can be used to limit the travel of each of the pistons 28 to within the sheet 26, which can prevent the pistons 28 from falling out of the sheet 26 when the layer 12 is not connected to and/or removed from the print structure 10.

Each of the pistons 28 may have a circular shape or non-circular shape, which facilitates mitigating rotation. It is to be appreciated that the pistons 28 and/or the apertures 30 can be associated with various other shapes in order to provide substantially similar and/or different characteristics. A gap 32 resides between the sheet 26 and each of the pistons 28. In some instances, the sheet 26 is held at electrical ground. In such instances, electrical charge can flow across the apertures 30 to the pistons 28 through at least one of direct surface-to-surface contact, conductivity present in the ink, a conductive grease, as well as through other techniques. Using a conductive grease or ink in the gap 32 can also provide lubrication that mitigates stiction.

An inside surface 34 of each of the pistons 28 resides proximate an elastomer layer 36. The elastomer layer 36 can be a flexible membrane, including a material used for macroscopic artificial muscle devices. In addition, the elastomer 36 can retain a lubricant that forms a bound monolayer. Use of such materials may form protective monolayer on exposed surfaces. In one instance, the inside surface 34 contacts the elastomer layer 36.

A photoconductor 38 is disposed between the elastomer layer 36 and a substrate 40, which can be formed as a sheet, a cylinder, etc. The photoconductor 38 may be transparent or semi transparent. In some instance, a surface 42 of the substrate 40 facing the photoconductor 38 is coated with a conductive material 44, which may also be transparent or semi transparent. The conductive material 44 typically is electrically biased with respect to the sheet 12. For example, the conductive material 44 may be biased with a positive or negative voltage potential with respect to sheet 12.

In an "off" state, the photoconductor 38 behaves as an insulator and thereby limits the electric field across the elastomer 36. Any deformation of any of the pistons 28 within the elastomer 36 due to electrostatic forces is minimal due to the limited field strength. In an "on" state, the photoconductor 38 is exposed to light through the substrate 40 and the conductive material 44. In one instance, a raster output scanner (ROS) or image bar is used to source the light. As a result, charge migrates from the conductive material 44 across the photoconductor 38 and creates an electrostatic image against the elastomer 36. The relatively higher electric field across the elastomer causes one or more of the pistons 28 to be pulled into the elastomer 36.

In the "off" state, the electric field across the elastomer 36 is a function of the following:

$$E_e = \frac{Vk_p}{t_e k_p + t_p k_e},$$

wherein V is the applied voltage and $k_p$ and $k_e$ are the dielectric constants of the photoconductor 38 and the elastomer 36, respectively, and $t_p$ and $t_e$ are the thicknesses of the photoconductor 38 and the elastomer 36, respectively. When the photoconductor 38 is substantially discharged, the field across the elastomer is a function of the following:

$$E_e = \frac{V}{t_e}.$$

In order to have a large switching ratio for the electric field applied to the elastomer 36, the photoconductor 38 is formed to be relatively thick with a small dielectric constant. The deflection of each of the pistons 28 has a super-linear dependence on the electric field across the elastomer 36. In the "off" state, the deflection can be a fraction of a micron, and in the "on" state, it can be many microns. The photoconductor 38 provides a very compact form of high voltage switch with a suitable on-off ratio.

Figure 3:
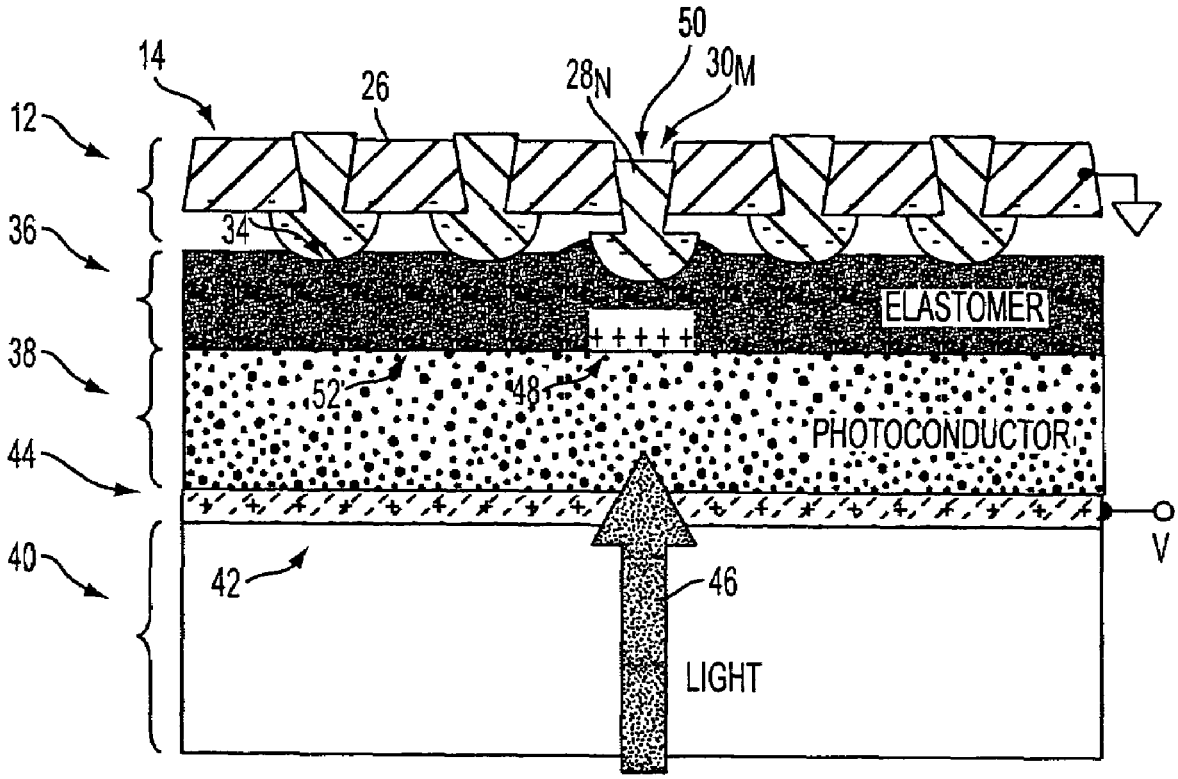
FIG. 3 illustrates the exemplary print structure in an "on" state.

FIG. 3 illustrates the print structure 10 in the "on" state. As depicted, a light source 46 is transmitted through the substrate 40 and the conductive material 44. Charge 48 migrates from the conductive material 44 through the photoconductor layer 38 to the elastomer layer 38. In this example, the charge 48 pulls a piston 28N (where N is an integer equal to or greater then one) through an aperture 30M (where M is an integer equal to or greater then one) within the sheet 12, creating a well 50.

In one instance, when the elastomer 36 flexes, its volume does not change appreciably. A consequence of this is that in order for the piston 28 to move down when it is pulled by an electrostatic force, the elastomer 36 must gain volume to the sides of the piston by contracting or bulging. In some artificial muscle actuators, this is accomplished by pre-tensioning the elastomer. A similar approach can be employed in this invention by stretching the elastomer 36 over the print surface.

Once the piston 28N is pulled into the elastomer 36, a material such as a viscous ink can be applied (e.g., via a squeegee, a roller, etc.) over the surface 14, including the well 50. The mechanism used to apply the material exerts a pressure that pushes the ink into the well 50. In some, but not all, instances, the pressure additionally moves one or more of the other pistons 28, creating more wells 50 that fill with the material. This could occur, for example, if the pressure is high enough and the applicator is deformable enough to push the pistons 28 down and load them with the material as it passes.

The ink volume delivered is a monotonic function of the applied voltage across the elastomer 36. The above discussion relates to a substantially insulating photoconductor. However, a partially conducting photoconductor enables writing of varied amounts of charge onto the elastomer 36. This can be achieved by varying light intensity in order to achieve a desired voltage level on the elastomer 36.

The pressure applied to a surface of each of the pistons 38 is a function of the following:

$$P = -\epsilon_0 k_0 E_e^2,$$

where $\epsilon_0$ is the permittivity of free space. This expression is valid for strains of up to approximately 20%. By expressing the strain as a change in the initial thickness of the elastomer 36, the expression for the thickness of the elastomer 36 is a function of the following:

$$t_e^3 - t_{e0} t_e^2 + c = 0,$$

wherein $$c = \frac{\varepsilon_0 k_e t_{e0} V^2}{Y}, t_{e0}$$

is the initial thickness of the elastomer 36 in zero applied field, and Y is the elastic modulus of the elastomer 36. The constant c is the strain predicted if one does not allow for the field enhancement stemming from the change in elastomer thickness.

After the material is applied to the surface 14 and the charge is removed, the pistons 28 will substantially return to their initial position, pushing any material associated therewith up as they recoil. This results in a surface with material above those areas where the pistons 28 were actuated. The material can then be transferred to another surface, substrate, or the like. In one instance, the surface 14 may be covered with a flexible elastomer to prevent dirt, dust, ink, etc. from clogging the mechanism and/or facilitate cleaning of the print surface 14. This material may be, for instance, induction welded or laser welded to the metal surface. In these methods, the gap between the pistons and the support grid can stay clean.

It is to be appreciated that the print structure 10 can accommodate a constant volume. Several features of the print structure 10 that facilitate accommodation of the constant volume include, but are not limited to, electrodes that slip, the gaps 32 around the pistons 28, and/or a shape of the heads of the pistons 28. For example, using a dome shaped piston head (as illustrated in FIGS. 2 and 3) can increase the area of electrode contact as the piston 28 is pulled into the elastomer 36. This can enhance a non-linear actuation, which can be leveraged to improve the on-off ratio of the structure. In another example, the elastomer 36 can be formed from one or more adhesive based acrylics in which the slipping capability is enabled with a surface treatment or lubricious coating. A carbon grease substantially similar to that used for making artificial muscle can also be used with the structure. Using such carbon grease and/or a comparable conducting lubricant facilitates maintaining electrical conductance between the sheet 12 and the pistons 28. Additionally or alternately, a thin layer of dielectric lubricant can be used. The thin layer can be associated with a relatively high dielectric constant that would have negligible affect on the overall electric field applied across the elastomer 36.

A photoconductor-elastomer interface 52, volume conservation can be enhanced by providing a dielectric lubricant at the interface 52 in order to allow it to slip. Although the elastomer 36 can be designed to slip with respect to the photoconductor 38, which typically is solidly attached to the substrate 40, it can be held in place by various mechanism in order to hold the structure together. For example, in one instance the elastomer 36 is stretched and clamped or bonded outside of an active area. Incorporation of a lubricant can facilitate the stretching. The sheet 12 and/or the pistons 28 can be attached by adhered dielectric standoffs and/or other mechanisms. The structure can also be held together through the compressive Maxwell stress that actuates the pistons 28. A typical force on the sheet 12 and/or the elastomer 36 is less than the localized force on the pistons 28, but is on the order of a couple of PSI when the structure is in an unswitched state. For a printing device with an area of 12 inches by 12 inches, a total force on the order of about 300 lbs typically holds the sheet 12 and/or the pistons 28 against the elastomer 36 and/or the photoconductor 38. Another technique is to apply a voltage to hold the sheet 12 and subsequently spot-weld the edges of the sheet 12 together to hold it in place.

Gaps around the pistons 28 provide the elastomer 36 somewhere to go as the thickness under the pistons 28 is reduced. In one instance, pretension on the elastomer 36 is used to facilitate accommodating the volume around the electrodes. For example, the elastomer 36 can be stretched and clamped at the edges before it is incorporated into the structure. This can also facilitate establishing a suitable thickness for the structure. In one instance, the elastomer 36 is about 0.5 to 1.0 mm think and is stretched about 4× in an x and/or y direction, which can results in a thickness of about 30 to 60 μm. The elastomer 36 may also be fabricated using a molding technique, e.g., from a silicone or an acrylic material. When using molding, the surface of the elastomer 36 facing the pistons may be patterned with gaps to allow for lateral expansion of the elastomer 36 when the pillars are pulled into the elastomer 36.

Optical addressing is described herein. However, other address schemes such as an active matrix backplane of high voltage thin film transistors may also be used for addressing the elastomer-actuated pistons described herein.

Figure 4:
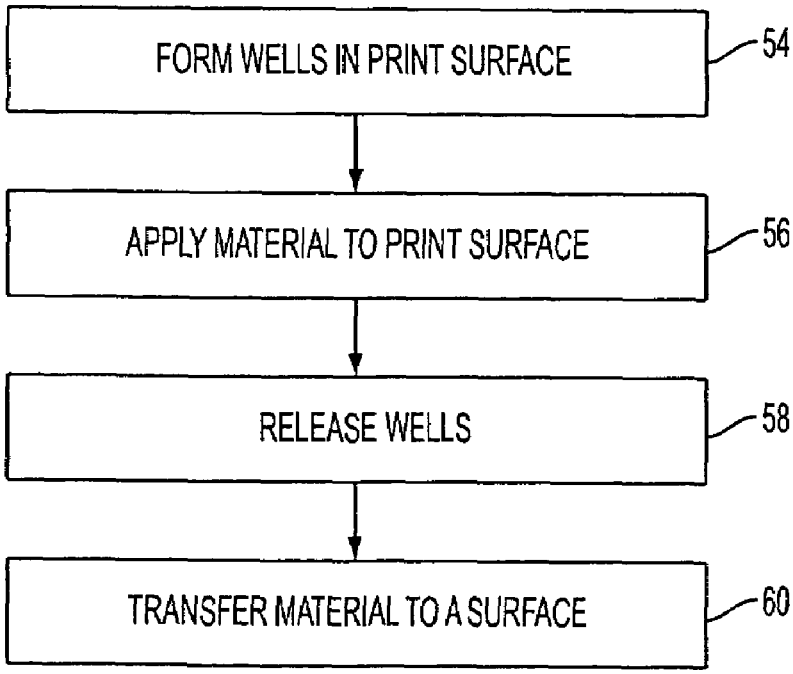
FIG. 4 illustrates a method for printing with the exemplary print structure.

FIG. 4 illustrates a method for printing with the print structure 10. At reference numeral 54, a portion of the surface 14 is deformed to create the one or more wells 50 that form a pattern on the surface 14. This can be achieved through electrostatic charge or other mechanism. For instance, light can be directed through the substrate 40 and the conductive material 44 to the photoconductor 38. The light can be sourced from a raster output scanner (ROS) or image bar. The light can induce charge associated with the conductive material 44 to migrate across the photoconductor layer 38 and form an electrostatic image against the elastomer layer 36, which creates an electric field that pulls one or more of the pistons 28 into the elastomer layer 36.

At 56, a material such as a viscous ink can be applied (e.g., via a squeegee, a roller, etc.) over the surface 12 and the wells 50. The mechanism used to apply the material exerts a pressure the pushes the material into the wells 50. The pistons 28 return to about their initial position, pushing any material associated therewith up as they recoil. Any extraneous or excess material can be eliminated by running a cleaning blade or the like over the surface 14. At reference numeral 58, the applied voltage is discharged, allowing all of the pistons 28 to return to about their initial positions. This results in a surface that is inked in those areas where the pistons 28 were actuated. At 60, the material can be transferred to another surface.

Figure 5:
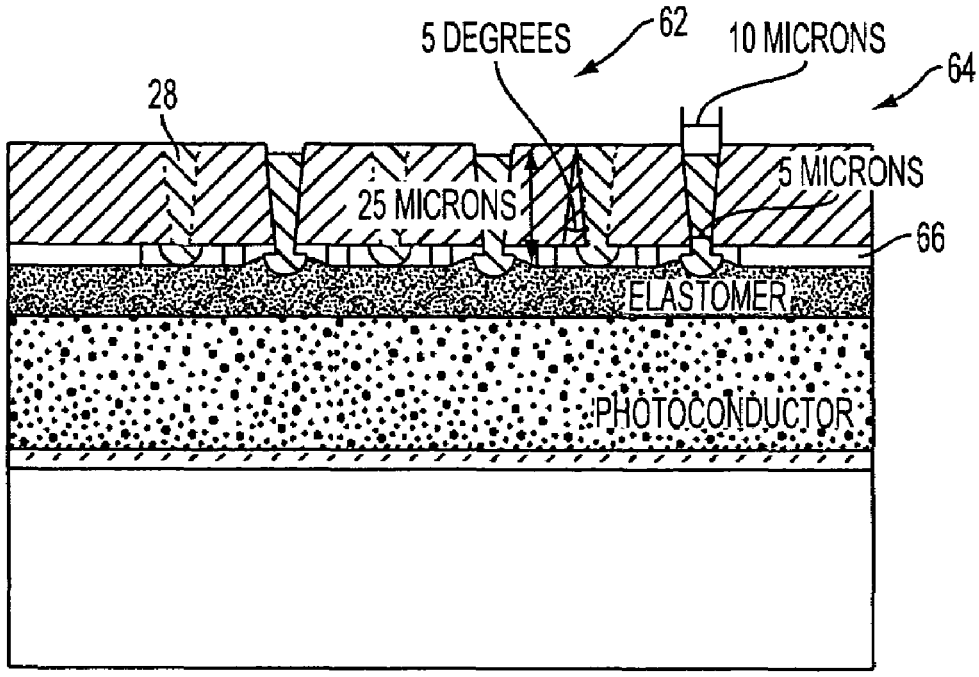
FIG. 5 illustrates a portion of an exemplary print structure with a large ink volume on-off ratio.

FIG. 5 illustrates a portion of the print structure 10 with a large ink volume on-off ratio. For this example, the print structure 10 has a plurality of pistons 28 arrayed at approximately 1000 dots per inch (DPI). The pistons 28 are designed to have a taper of about 5 degrees over a 25 micron length as illustrated at 62. On the surface 14, the pistons 28 have a diameter of about 10 microns and, on an opposing surface located proximate the elastomer 36, the pistons 28 have a diameter of about 5 microns, as illustrated at 64. The gaps 32 between each of the pistons 28 and the sheet 12 is about 0.25 microns. This provides a vertical flexibility of about 3 microns.

The volume displaced by each of the pistons 28 over its range of travel is about 200 cubic microns (0.2 pico-liters). The flexibility of each of the pistons 28 can optionally be designed to be greater than the range of motion that each of the pistons 28 will ever encounter during printing operations. The drag on each of the pistons 28 is inversely proportional to the gaps 32. An optional patterned dielectric spacer layer 66 is disposed between the sheet 12 and the elastomer 36. The patterned dielectric spacer layer 66 minimizes interactions between neighboring pistons 28. This facilitates mitigating pulling portions of the sheet 12 into the elastomer 36 by actuated pistons 28 when an extended area is written with charge. This pixel-wise support structure allows the structure to faithfully reproduce low spatial frequency content of an electrostatic image.

In instances where the pistons 28 are made out of electroformed nickel or permalloy, the expansion rate of the pistons 28 typically will range from about 7 to about 13.4 ppm/° C. Over a 12 inch wide drum, a 10° C. temperature change may elicit about a 30 μm change in a size of an array of the pistons 16 across the substrate 40. In instances where the body of the substrate 40 is formed from glass with an expansivity of about 10 ppm/° C., the run-out between a body of the substrate 40 and the pistons 28 will be only a few microns over 12 inches. The relative run out between the pistons 28 and the substrate 40 typically is an amount that the elastomer 36 can accommodate. With suitable materials selection, a nearly exact thermal expansion match can be achieved. In instances where there is only one patterned element (e.g., the sheet 12 with the embedded pistons 28), there is no misalignment of fine features due to temperature changes.

Figure 6:
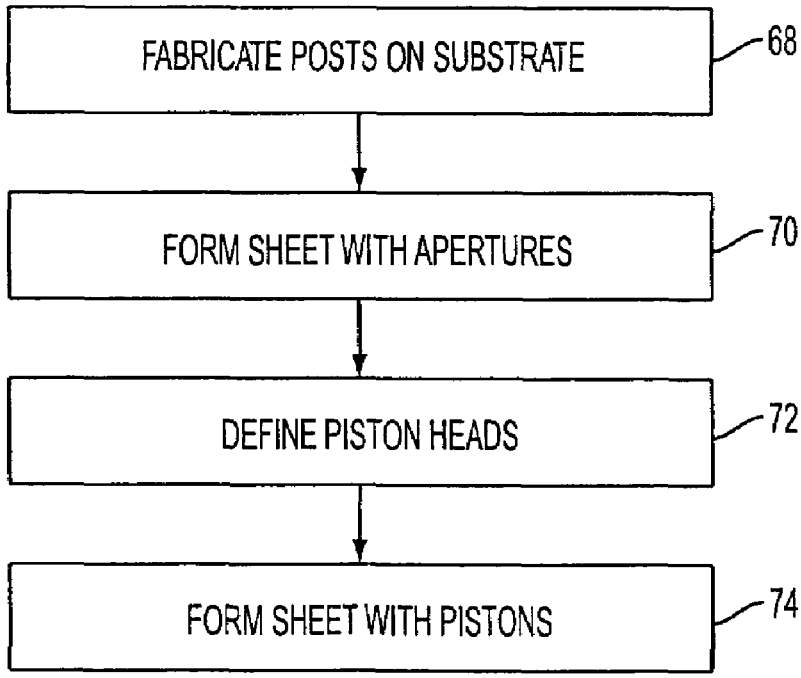
FIG. 6 illustrates an exemplary technique for creating the print layer having a plurality of pistons embedded within a sheet.

The printing structure described herein may include millions (e.g., more than 100 million) functioning pistons 28 in order to produce high resolution images. In one instance, an electroforming technique can be used to create the sheet 12 and the pistons 28 of the printing structure. FIG. 6 illustrates an exemplary electroforming technique for creating the sheet 12 with the embedded pistons 28.

At reference numeral 68, an array of posts is fabricated onto a smooth substrate that is metallized with an electroplating seed layer. The posts can be constructed from a photoresist layer or the like in which portions of the photoresist layer are exposed with a dose that fully develops the portions, leaving behind the posts, which may be relatively narrower at an end farthest away from the substrate. The seed layer can be formed from a thin Ti layer with a thin cladding of gold or otherwise.

At 70, a sheet of metal (e.g., nickel, copper, permalloy, etc.) with one or more apertures is plated up from the substrate. This can be achieved by providing an electroplating seed layer on the substrate prior to fabricating the posts and using this seed layer as a cathode during electroplating. Typically, the metal is formed in a space filling layer everywhere except where it is blocked by the posts. Once the sheet of metal is formed, it can optionally be flattened by a chemical mechanical polishing (CMP) technique. A dielectric spacer layer may be introduced by a technique such as spinning and patterning a dielectric such as polyimide or the like. The purpose of this dielectric spacer layer is to prevent the entire foil from getting pulled into the elastomer and thereby limit actuation to the piston. The posts are then removed, for example, by dissolving the posts in a resist stripper.

At reference numeral 72, a mask can be applied to introduce a pattern to define heads for the pistons. In one instance, a negative acting resist is used to introduce a re-entrant sidewall to the resist so that the heads that are formed will be wider at the end closest to the substrate and narrower at the end farthest from the substrate. Such structure may better accommodate a deforming elastomer as described previously. The resulting structure, with its re-entrant holes is coated with a conformal sacrificial layer. A suitable technique for applying the sacrificial layer is electroplating. For example, gold can be electroplated onto the exposed conducting surfaces. At reference numeral 74, electroforming can be used to plate up metal to define the pistons. The second resist mask and the release layers are removed, separating the pistons from the sheet and separating the sheet and the pistons from the substrate.

Table 1 illustrates various input parameters and results (e.g., strains, thicknesses, deflections, etc.) predicted in design calculations based on the known values for the materials employed and reasonable dimensions for the elastomer 36 and/or the photoconductor 38. In this case, the photoconductor 38 can be a multi-layer active matrix (AMAT) type. A typical example is a combination of a generator layer, such as benzimidazole perylene (BZP), and a thick hole transport layer such as triphenyl diamine derivative (TPD).

TABLE 1

Exemplary Modeling Parameters and Results

| Input Parameters | | |
|---|---|---|
| Voltage | 2000 | Volts |
| Permitivity | 8.85E−12 | F/m |
| Elastomer Modulus | 2 | Mpa |
| Elastomer Dielectric Constant | 4.8 | |
| Elastomer Relaxed Thickness | 25 | μm |
| Photoconductor Thickness | 35 | μm |
| Photoconductor Dielectric | 2.9 | |
| Piston Diameter | 5 | μm |

| Results | Switched | Unswitched |
|---|---|---|
| Initial Elastsomer Field | 80.0 MV · m | 24.1 MV/m |
| C | 0.136 | 0.012 |
| Normalized Length | 0.772 | 0.987 |
| Strain | 22.82% | 1.27% |
| Thickness | 19.29 μm | 24.68 μm |
| Deflection | 5.71 μm | 0.32 μm |
| Elastomer Field | 103.7 MV · m | 24.2 MV/m |
| Photoreceptor Field | 0.0 MV/m | 40.1 MV · m |
| Ink Volume/Pixel | 112.0 μm ^3 | 6.2 μm ^3 |

From Table 1, the dielectric constant of the photoconductor 38 can be on the order of 2.9. A vertical displacement of the piston 28 on the order of 5 microns can be achieved with an applied voltage of about 2000 Volts. For a piston 28 about 5 microns in diameter, this represents a volume of ink of about 100 μm3, which is equal to about 0.1 pico-liters. Ink jet delivery systems have drop sizes that are typically much larger. Thus, the print structure 10 can provide for variable data printing at higher resolution and with higher quality inks than current ink printers and laser printers. The piston length can be designed such that it is slightly longer than a thickness of the sheet 12 in order to produce a well of zero volume in the off state.

It is to be appreciated that the printing structure 10 described herein can be adapted for offset printing, wherein an inked impression from a plate is first made on a rubber-blanketed cylinder and then transferred to the paper being printed. The offset printing technique can be leveraged in instances where paper fibers have an undesirable affect on the pistons 28. In such instances, an intermediate rubber cylinder may extend the service life of the pistons 28.

The methods described above in FIGS. 4 and 6 illustrate as a series of acts; however, it is to be understood that in various instances, the illustrated acts can occur in a different order. In addition, in some instance, the one or more of the acts can concurrently occur with one or more other acts. Moreover, in some instance more or less acts can be employed.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A print structure for transferring materials, comprising:

a first layer, including;

a foil sheet, one or more apertures within the foil sheet, and one or more pistons that move within the one or more apertures to form one or more wells for holding a material within said one or more wells, wherein the one or more pistons are in electrical communication with the foil sheet such that there is a flow of electrons between the foil sheet and the one or more pistons;

an elastomer in which the one or more pistons are pulled into when forming the one or more wells; and a photoconductor that switches an electric field across the elastomer.

2. The print structure as set forth in claim 1, wherein the one or more pistons include an array of co-fabricated micro-machined pistons.

3. The print structure as set forth in claim 1, wherein the foil sheet is held at electrical ground potential.

4. The print structure as set forth in claim 1, further including a spacer disposed between the elastomer and the first layer to minimize interactions between neighboring pistons.

5. The print structure as set forth in claim 1, wherein each of the one or more pistons have a non-circular shape to prevent rotating.

6. The print structure as set forth in claim 1, further including a flexible elastomer cover that protects the first layer from the environment and/or facilitates retaining a lubricant within the structure.

* * * * *